US005470205A

United States Patent [19]

Conklin, Jr.

[11] Patent Number: 5,470,205

[45] Date of Patent: Nov. 28, 1995

[54] DECORATIVE FAN BLADE

[76] Inventor: Dennis R. Conklin, Jr., 2005 E. University Dr., Phoenix, Ariz. 85034

[21] Appl. No.: 238,218

[22] Filed: May 4, 1994

[51] Int. Cl.[6] ..... F04D 29/38

[52] U.S. Cl. ..... 416/205; 416/210 R; 416/229 R; 416/241 R; 416/62

[58] Field of Search ..... 416/5, 61, 62, 416/146 R, 204 R, 205, 210 R, 229 R, 241 R; D23/370, 377, 379, 385, 413

[56] References Cited

U.S. PATENT DOCUMENTS

| | | | |
|---|---|---|---|
| 2,701,540 | 2/1955 | Hamilton | 416/61 |
| 3,288,359 | 11/1966 | Sampson | 416/71 |
| 3,757,730 | 9/1973 | Douglas | 416/5 |
| 4,676,721 | 6/1987 | Hardee . | |
| 4,753,573 | 6/1988 | McKnight | 416/62 |
| 4,832,572 | 5/1989 | Prucha et al. . | |
| 4,936,751 | 6/1990 | Marshall | 416/205 |
| 5,110,261 | 5/1992 | Junkin . | |
| 5,224,830 | 7/1993 | Wang | 416/5 |
| 5,370,721 | 12/1994 | Carnahan | 416/62 |

FOREIGN PATENT DOCUMENTS

| | | | |
|---|---|---|---|
| 301995 | 12/1989 | Japan | 416/5 |

*Primary Examiner*—Edward K. Look
*Assistant Examiner*—James A. Larson
*Attorney, Agent, or Firm*—Parsons & Associates; Robert A. Parsons; Don J. Flickinger

[57] ABSTRACT

A form having a base, a tip, and a major surface, an adhesive layer carried on the major surface and a protective sheet removably covering the adhesive layer, forming a decoratable fan blade removably mountable on a ceiling fan.

9 Claims, 2 Drawing Sheets

FIG. 1
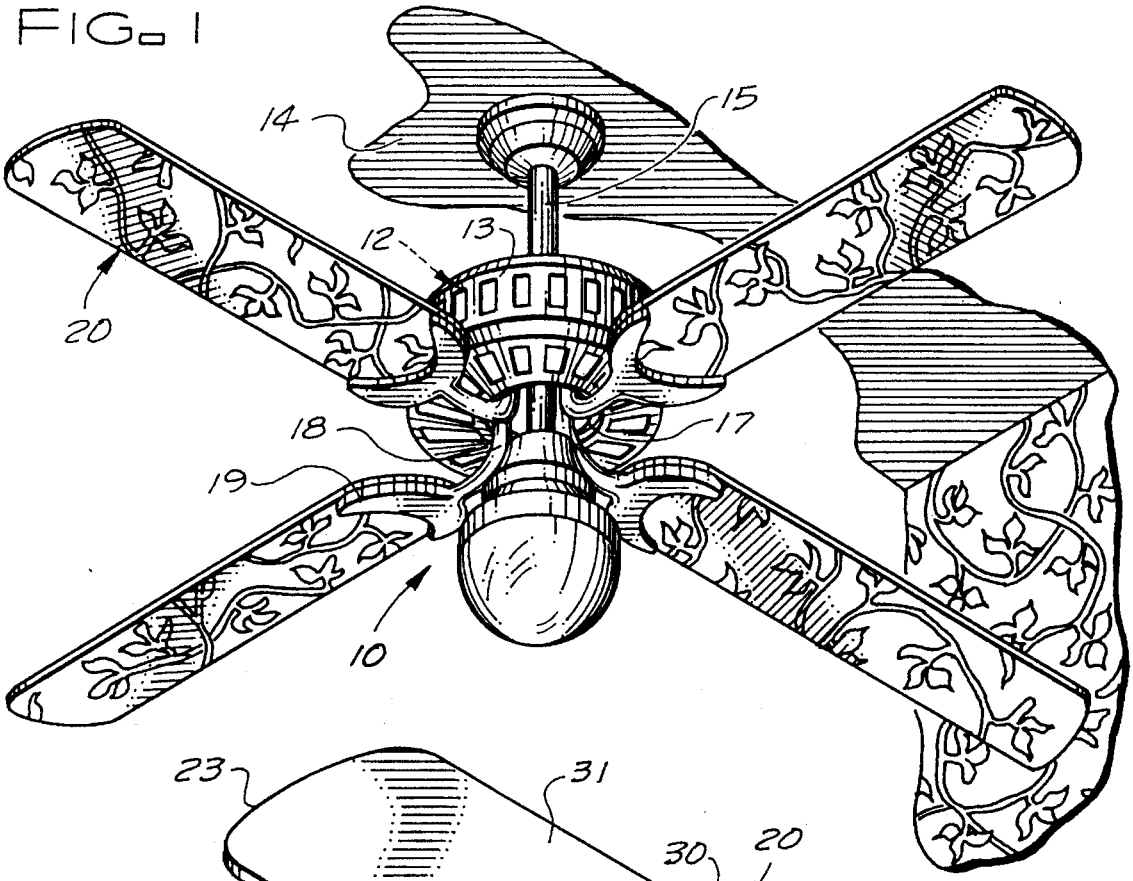
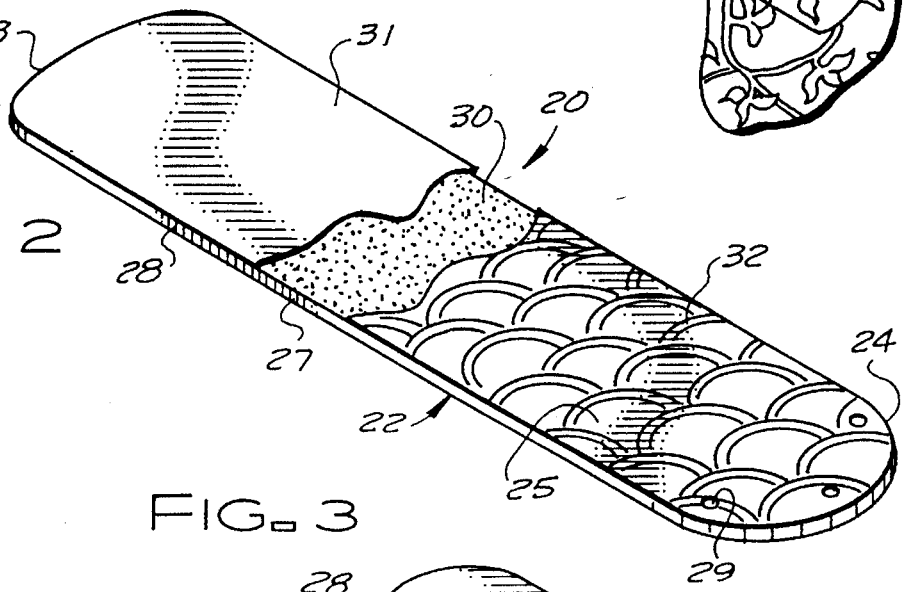
FIG. 2
FIG. 3
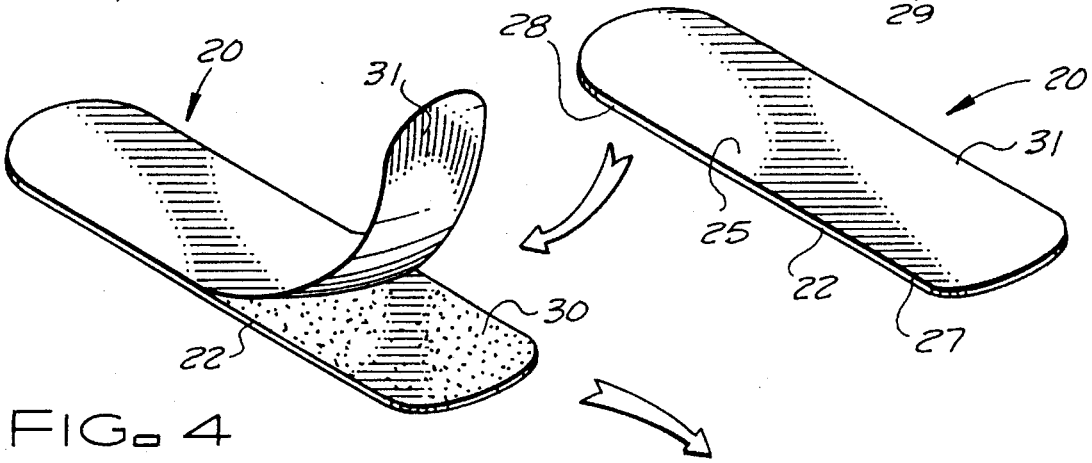
FIG. 4

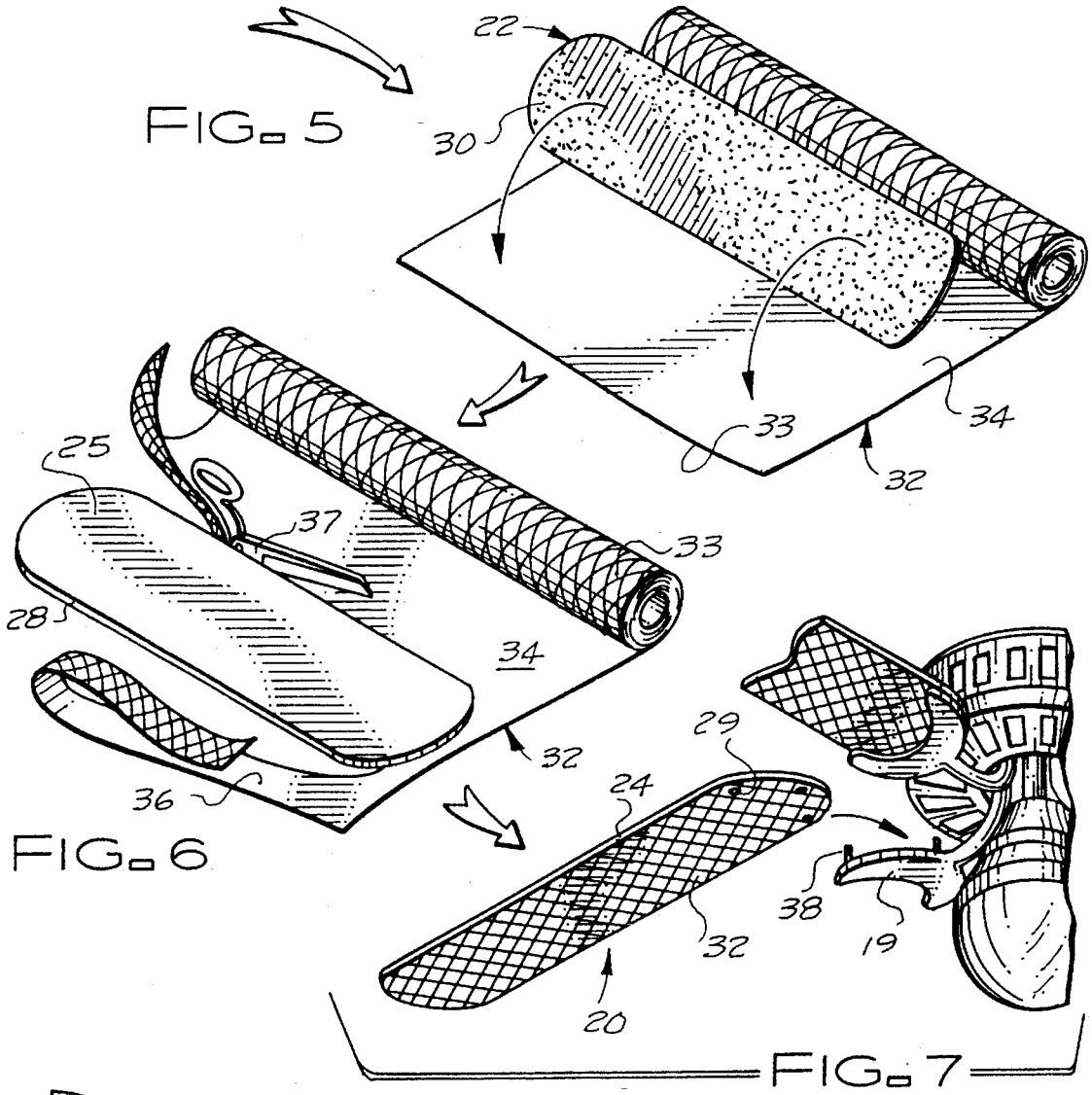
FIG. 5
FIG. 6
FIG. 7
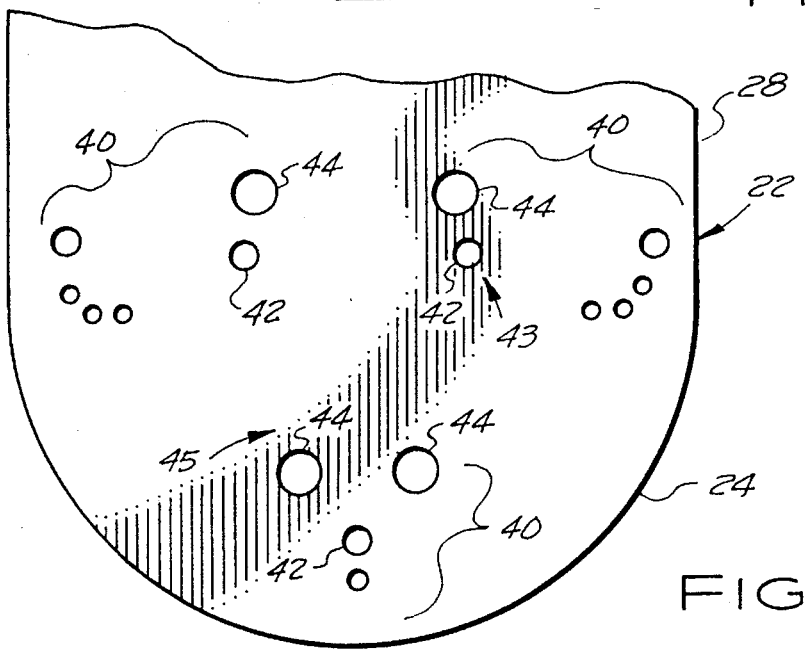
FIG. 8

DECORATIVE FAN BLADE

BACKGROUND OF THE INVENTION

1. Field of the Invention

This invention relates to ceiling fan devices.

More particularly, the present invention relates to fan blades for ceiling fans.

In a further and more specific aspect, the present invention concerns improved fan blades which can be individually decorated as desired.

2. The Prior Art

Conventional fans such as ceiling fans are well known in the prior art for circulating air. These fans are generally equipped with a motor having a rotor to which are connected a plurality of radially extending fan blades. Fan blades are coupled to the rotor by brackets which generally attach to three holes formed in the base of the fan blade. Many times, ceiling fans not only provide air movement for a room, but also provide a decorative accent.

Typically, fan blades are manufactured from a variety of materials and sizes to provide a choice of styles. The most common types of blades are made from wood which may be stained different shades to provide somewhat different looks. Different varieties of wood also add diversity. The problem with trying to match a decor with available blades is the extremely limited selection usually found. Most people with ceiling fans simply accept the blades they receive with their fan, even if the blades do not provide the desired accent or even if they detract from a room. The blades provided are generally generic type blades that have been produced in an attempt to match any decor. This of course, is generally not extremely successful.

Replacement blades can be found, but again, the selection is very limited. Furthermore, many stores do not carry replacement blades because many ceiling fans require their own design of fan blade. Specifically, the hole arrangement at the base of the fan blade for attaching the bracket, must match the type of bracket used in different brands of fans. Therefore many types of fan blades are needed just to provide replacements for the different fans. This does not even provide decorative fan blades which would expand the number outrageously.

When a specific style is desired, an individual can have custom fan blades prepared. In this manner, substantially any decor can be matched. This, however, is an extremely expensive solution to the problem, since generally, custom blades are formed from specific materials, such as brass, specific type of wood with a specific stain, or hand painted blades to provide specific detailing and colors. Besides being expensive, it is often difficult to find someone willing and able to produce a custom fan blade.

It would be highly advantageous, therefore, to remedy the foregoing and other deficiencies inherent in the prior art.

Accordingly, it is an object of the present invention to provide a new and improved ceiling fan blade.

Another object of the present invention is to provide a decorative ceiling fan blade.

And another object of the present invention is to provide an inexpensive custom ceiling fan blade.

Still another object of the present invention is to provide a method of decorating ceiling fan blades.

Yet another object of the present invention is to provide a ceiling fan blade which can be decorated to match substantially any decor.

Yet still another object of the present invention is to provide a ceiling fan blade which is easy to decorate.

A further object of the present invention is to provide a fan blade which may be installed on substantially any ceiling fan.

And a further object of the present invention is to provide a fan blade fitted with openings to match substantially any ceiling fan bracket.

Yet a further object of the present invention is to provide a kit for decorating a ceiling fan.

And yet a further object of the present invention is to provide a method of decorating a ceiling fan.

SUMMARY OF THE INVENTION

Briefly, to achieve the desired objects of the present invention in accordance with a preferred embodiment thereof, provided is a decoratable fan blade removably mountable on a ceiling fan. The fan blade includes a form having a base, a tip, and a major surface. An adhesive layer is carried on the major surface and removably covered by a protective sheet.

A further embodiment of the decoratable fan blade includes a plurality of openings formed in the base for mounting the fan blade on the ceiling fan. The plurality of openings include a plurality of alternate opening configurations. It is further contemplated that the alternate opening configurations each include a plurality of openings having different spacing therebetween and furthermore, the plurality of openings may include openings having different diameters.

In yet another embodiment, the fan blade further comprises an opposing second major surface, a second adhesive layer on the opposing second major surface and a second protective sheet removably covering the second adhesive layer.

Also provided in the present invention is a method of decorating a ceiling fan, comprising the steps of providing a plurality of decoratable fan blades, each including a form having a base, a tip, and a major surface, an adhesive layer on the major surface, and a protective sheet removably covering the adhesive layer, providing a decorative sheet of material having a decorative surface and a back surface, removing the protective sheet from the adhesive layer and placing the back surface of the sheet on the major surface, contacting the adhesive layer so as to affix the decorative sheet firmly to the form.

The method includes in addition the step of trimming the sheet of material to coincide with the form. The form includes a peripheral edge which is used as a trimming guide.

The method further includes each fan blade having an opposing second major surface, a second adhesive layer on the opposing second major surface and a second protective sheet removably covering the second adhesive layer and the additional steps of providing a second decorative sheet of material having a decorative surface and a back surface, removing the second protective sheet from the second adhesive layer and placing the back surface of the second decorative sheet on the opposing second major surface, contacting the second adhesive layer so as to affix the second decorative sheet firmly to the form.

Also provided in the present invention is a method of fabricating a decoratable fan blade comprising the steps of providing a form to be decorated having a tip, a base, and a major surface, providing an adhesive layer sandwiched between a first and a second removable protective sheet and removing the first protective sheet and applying the adhesive layer to the major surface.

The method may include providing a form having an opposing second major surface, and including in addition the steps of providing a second adhesive layer sandwiched between a first and a second removable protective sheet and removing the first protective sheet and applying the second adhesive layer to the opposing second major surface.

Further provided is a fan blade removably mountable on substantially any ceiling fans, said fan blade comprising a form having a tip, a base, a first major surface and a second opposed major surface, a plurality of openings formed through the form proximate the base and the plurality of openings positioned in three groupings, each opening of the plurality of openings in each grouping cooperating with corresponding openings in each of the other groupings to define a plurality of opening configurations. Each of the plurality of opening configurations includes openings having different spacing therebetween.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 1 is a perspective view of a ceiling fan with fan blades constructed in accordance with the teachings of the present invention installed thereon;

FIG. 2 is a perspective view of a ceiling fan blade constructed in accordance with the teachings of the present invention, with portions cut away for purposes of illustration;

FIGS. 3–6 illustrate the steps involved in decorating the fan blade of the present invention;

FIG. 7 is a perspective view illustrating the installation of the fan blade of the present invention on a ceiling fan; and FIG. 8 is a partial top plan view of the base of a fan blade illustrating a multiple hole arrangement.

DETAILED DESCRIPTION OF THE PREFERRED EMBODIMENT

Turning now to the drawings in which like reference characters indicate corresponding elements throughout the several views, attention is first directed to FIG. 1 which illustrates a ceiling fan generally designated 10. Ceiling fan 10 includes a driving motor 12 having a motor housing 13 secured to a ceiling 14 of a structure such as a building or the like by a support 15, a central disk 17 secured on a drive shaft (not visible) driven by driving motor 12, a plurality of fan blades 20 radiating from and coupled to central disk 17 by fixing arms 18, each terminating in a bracket 19 which engages one of fan blades 20.

Set forth for purposes of orientation and reference in connection with the ensuing description of the preferred embodiment of the instant invention, the foregoing brief description of ceiling fan 10 is intended to be generally representative of conventional, commercially available fans of the type. Details not specifically illustrated and described will be readily understood and appreciated by those skilled in the art.

With additional reference to FIG. 2, each fan blade 20 further includes a form 22 having the desired shape of the blade. Form 22 may be substantially any material suitable for a fan blade, including plastic, wood, metal and the like. The preferred material being a wood composite or plastic. Form 22 includes a tip 23, an opposing base 24, a top surface 25 and a bottom surface 27. A peripheral edge 28 extends completely around fan blade 20 from tip 23 to base 24 and back again. Base 24 includes a plurality of openings 29 formed therethrough for attachment to bracket 19. Further description of openings 29 will be found in the ensuing description. It will be understood the openings 29 may not be present, and only drilled in form 22 prior to mounting on a ceiling fan. Bottom surface 27, the surface directed away from ceiling 14, carries an adhesive layer 30. Adhesive layer 30 is covered by a protective sheet 31 which protects adhesive layer 30 and keeps it tacky, in an unset condition, preparatory to bonding to a decorative sheet 32. Upon removal of protective sheet, adhesive layer 30 is presented in condition to receive and bond decorative sheet 32.

Decorative sheet 32, having a decorative surface 33 and a back surface 34, covers bottom surface 27 from tip 23 to base 24 bounded by edge 28, with back surface 34 adjacent bottom surface 27, and is bonded thereto by adhesive layer 30. Preferably, adhesive layer 30 completely coats bottom surface 27 in order to securely bond decorative sheet 32 to bottom surface 27, but one skilled in the art will understand that adhesive layer 30 may sporadically cover bottom surface 27 and adequately bond decorative sheet 32. The portion of decorative sheet 32 covering openings 29 may be removed for installation.

Decorative sheet 32 may be substantially any type of material such as wrapping paper, fabric, wall paper, foil, plastic sheet and the like. For example, with reference back to FIG. 1, it may be desirable to provide fan blades 20 which match a specific wall paper used in a room. To provide this unique accent, matching wall paper may be used as decorative sheet 32 on fan blades 20. In this manner an exact match may be obtained easily and at low expense. Any style or design may be used as long as it is available on a sheet of material.

This is a low cost alternative to expensive custom fan blades. Another example is using silver or gold wrapping foil to provide fan blades which appear to be chrome or brass. While the blades look like the custom blades, the expense is substantially less. Since the cost is low, an individual may employ more than one set for each fan. For example, a set of blades may be made for specific holidays such as Christmas. When the holiday approaches, the every day blades are removed and the holiday blades are installed. This would be cost prohibitive for custom blades.

Turning now to FIG. 3, fan blade 20, prior to decorating, is illustrated. Fan blade 20, prior to decorating, is fabricated by providing form 22, providing adhesive layer 30 sandwiched between protective sheet 31 and an additional protective sheet not shown, removing the additional protective sheet to expose adhesive layer 30 and applying adhesive layer 30 to bottom surface 27 of form 22. The preferred adhesive layer, including the protective sheets is a polyester release liner rubber based double sided adhesive. After fabrication, but prior to decorating, 14 fan blade 20 includes form 22 having adhesive layer 30 carried on bottom surface 27 and covered by protective layer 31 as described previously.

A method of decorating a fan blade according to the present invention is illustrated in FIGS. 4–6. The first step is to remove protective sheet 31 to expose adhesive layer 30 on bottom surface 27 as shown in FIG. 4. This is accomplished by grasping an edge of protective sheet 31 and peeling it upward, thereby separating it from form 22 and adhesive layer 30. The second step is bonding decorative sheet 32 to bottom surface of form 22. The preferred method is to lay decorative sheet 32 flat, with back surface 34 directed upwardly and decorated surface 33 directed downwardly. Form 22 is then placed on decorative sheet 32 with adhesive layer 30 contacting back surface 34. While this is the preferred method of the second step, one skilled in the art will understand that form 22 may be laid flat with bottom surface 27 directed upwardly, and decorative sheet 32 laid upon form 22 with back surface 34 contacting adhesive layer 30.

The third and final step is to remove excess portions 36 of decorative sheet 32 extending past edge 28 of form 22. This is accomplished by using a cutting instrument 37 such as a pair of scissors. One skilled in the art will understand that other cutting instruments such as knives, razor blades or the like may be used. Form 22 acts as the template to follow, with edge 28 guiding cutting instrument 37. Fan blade 20 is now decorated and ready to be installed on ceiling fan 10.

While it has been shown that bottom surface 27 of form 22 is decorated, it will be appreciated by one skilled in the art that top surface 25 may be decorated in the same manner if desired. Generally this is not necessary since normally only bottom surface 24 is visible. However, in some rooms, such as rooms with lofts or the like, both top surface 25 and bottom surface 24 are visible. In this instance, it may be desirable to decorate the entire form.

Turning now to FIG. 7, fan blade 20 is illustrated being installed on ceiling fan 10. Installation is accomplished by engaging base 24 with bracket 19 in a conventionally known manner. Bracket 19 further includes threaded studs 38 extending upward therefrom which are configured to be received through openings 29 in form 22. Decorative sheet 32 may be removed from covering openings 29 prior to installation, or threaded studs 38 may be used to puncture the portion of sheet 32 covering openings 29. In either case, threaded studs 38 extend through openings 29 in base 24 and fan blade 20 is secured in place by nuts (not shown) which thread onto the ends of threaded studs 38.

Referring now to FIG. 8, a plurality of opening configurations are illustrated. Openings 29 are formed in base 24 of form 22 for attachment to a ceiling fan as described above. There are many companies fabricating ceiling fans, and many of these companies employ their own individual opening and bracket arrangement. Since the opening configuration required is different for many ceiling fans, this generally requires that a different fan blade be made for each type of ceiling fan. The opening configurations illustrated in FIG. 8 may be used to provide a generally universal arrangement of openings 29, allowing fan blade 20 to be mounted on substantially any ceiling fan. The plurality of openings 29 are generally arranged in three groupings 40, with each grouping containing an opening of one of the opening configurations. For example, an opening 42 is found in each grouping 40. Openings 42 together form an opening configuration 43 which permits fan blade 20 to be mounted on a specific ceiling fan. Another opening 44 is found in each grouping 40. Openings 44 together form an opening configuration 45. Spacing between openings 42 in opening configuration 43 and openings 44 in opening configuration 45 are different to allow mounting on different fans. Also, some of the openings 29 in groupings 40 having different diameters to accommodate different ceiling fans.

After bonding decorative sheet 32 to form 22, openings 29 required to be used for attachment to a specific ceiling fan are identified. Portions of decorative sheet 32 covering those opening are removed in preparation for installation.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A decoratable fan blade removably mountable on a ceiling fan, said fan blade comprising:

a form having a base, a tip, and a major surface;

an adhesive layer on said major surface; and a protective sheet removably covering said adhesive layer.

2. A decoratable fan blade as claimed in claim 1 wherein said base includes a plurality of openings for mounting said fan blade on said ceiling fan.

3. A decoratable fan blade as claimed in claim 2 wherein said openings include a plurality of opening configurations.

4. A decoratable fan blade as claimed in claim 3 wherein said plurality of opening configurations each include a plurality of openings having different spacing therebetween.

5. A decoratable fan blade as claimed in claim 2 wherein said plurality of openings include openings having different diameters.

6. A decoratable fan blade as claimed in claim 1 wherein said fan blade further comprises:

an opposing second major surface;

a second adhesive layer on said opposing second major surface; and a second protective sheet removably covering said second adhesive layer.

7. A fan blade removably mountable on substantially any ceiling fan, said fan blade comprising:

a form having a tip, a base, a first major surface and a second opposed major surface;

a plurality of openings formed through said form proximate said base; and said plurality of openings positioned in three groupings, each opening of said plurality of openings in each grouping cooperating with corresponding openings in each of said other groupings to define a plurality of opening configurations.

8. A fan blade as claimed in claim 7 wherein each of said plurality of opening configurations includes openings having different spacing therebetween.

9. A fan blade as claimed in claim 8 wherein at least some of the plurality of openings in each grouping have different diameters.

* * * * *